US010434763B2

(12) United States Patent
Ramsey et al.

(10) Patent No.: US 10,434,763 B2
(45) Date of Patent: Oct. 8, 2019

(54) INK JET PRINTING ON A METAL CAN SUBSTRATE

(71) Applicant: Crown Packaging Technology, Inc., Alsip, IL (US)

(72) Inventors: Christopher Paul Ramsey, Oxfordshire (GB); Matthew Buy, Maidenhead (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 14/773,917

(22) PCT Filed: Mar. 14, 2014

(86) PCT No.: PCT/US2014/028014
§ 371 (c)(1),
(2) Date: Sep. 9, 2015

(87) PCT Pub. No.: WO2014/152858
PCT Pub. Date: Sep. 25, 2014

(65) Prior Publication Data

US 2016/0016687 A1 Jan. 21, 2016

Related U.S. Application Data

(60) Provisional application No. 61/781,570, filed on Mar. 14, 2013.

(51) Int. Cl.
*B21D 51/44* (2006.01)
*B41J 2/01* (2006.01)
(Continued)

(52) U.S. Cl.
CPC ..... *B41J 2/01* (2013.01); *B41M 5/0047* (2013.01); *B41M 5/0058* (2013.01);
(Continued)

(58) Field of Classification Search
CPC ..... B21D 51/26; B21D 51/38; B21D 51/383; B21D 51/44; B21B 45/02; B21B 45/0239;
(Continued)

(56) References Cited

U.S. PATENT DOCUMENTS 3,292,194 A * 12/1966 Randall ..... C23G 3/00 15/77
3,888,199 A * 6/1975 Herrmann ..... B21D 51/383 413/17
(Continued)

FOREIGN PATENT DOCUMENTS

EP 2428359 A1 3/2012
WO WO 00/47487 A1 8/2000
(Continued)

*Primary Examiner* — Edward T Tolan
(74) *Attorney, Agent, or Firm* — BakerHostetler

(57) ABSTRACT

A method for forming a beverage can end (34*a*) having ink jet markings (50*a*) on its tab (36*a*) comprises a step of applying ink via an ink jet to a surface of tab stock, wherein the tab stock surface is unlubricated and substantially free of factory lubricant. The method further includes a step of lubricating the tab stock after the step of applying ink, a step of forming the tab stock into tabs, and a step of combining the tabs with an end shell to from the beverage can end.

16 Claims, 2 Drawing Sheets

(51) Int. Cl.
*B41M 5/00* (2006.01)
*B65D 17/28* (2006.01)
*B41J 3/407* (2006.01)

(52) U.S. Cl.
CPC ..... *B65D 17/4012* (2018.01); *B21D 51/44* (2013.01); *B41J 3/4073* (2013.01); *B65D 2203/00* (2013.01); *B65D 2517/0013* (2013.01); *B65D 2517/0014* (2013.01); *B65D 2517/0056* (2013.01); *B65D 2517/5091* (2013.01)

(58) Field of Classification Search
CPC ..... B21B 45/0242; B21B 45/0251; B21B 45/0269; B21B 45/0284; B41N 3/006; B41M 5/0047; B41M 5/0058; B41J 3/4073; B41J 2/01
See application file for complete search history.

(56) References Cited

U.S. PATENT DOCUMENTS 4,168,167 A * 9/1979 Takenaka ..... B41N 3/034 430/264
4,253,908 A * 3/1981 Stephen-Daly ..... B44C 3/087 216/100
4,380,129 A * 4/1983 Barrash ..... B65D 17/16 220/270
5,125,212 A * 6/1992 Smyth ..... B21D 51/383 53/133.8
5,672,401 A * 9/1997 Anglin ..... B65D 25/14 106/270
5,992,892 A 11/1999 Schaefer et al.
6,337,136 B1 * 1/2002 Suzuki ..... B41N 1/083 101/459
6,808,351 B1 * 10/2004 Brown ..... B65D 17/165 413/14
9,186,924 B2 * 11/2015 Lewis ..... B41M 5/24
9,340,368 B2 * 5/2016 Ellefson ..... B21D 43/003
2002/0090456 A1 7/2002 Mackey et al.
2012/0205386 A1 * 8/2012 Owen ..... B65D 25/34 220/626
2013/0075401 A1 * 3/2013 Forrest ..... B21D 51/383 220/270
2013/0098928 A1 * 4/2013 Selepack ..... B41M 1/28 220/660
2013/0129451 A1 5/2013 Lee
2013/0340885 A1 * 12/2013 Clayton ..... A47G 19/2227 141/11

FOREIGN PATENT DOCUMENTS

WO WO 02/085628 A1 10/2002
WO WO 2002/085553 10/2002
WO WO 2006/098597 A1 9/2006
WO WO 2012/015201 A2 2/2012

* cited by examiner

INK JET PRINTING ON A METAL CAN SUBSTRATE

CROSS-REFERENCE TO RELATED APPLICATIONS

This application is the National Stage of International Application No. PCT/US2014/028014, filed Mar. 14, 2014, which claims the benefit of U.S. provisional application No. 61/781,570, filed Mar. 14, 2013, the disclosures of which are incorporated herein by reference in their entirety.

BACKGROUND

The invention relates to metal beverage and metal food cans, and more particularly to marking or decorating metal cans and/or their raw materials, especially tab stock or tabs.

Conventional beverage cans include a can body and a can end. Beverage can bodies are typically formed from a 3000 series aluminum alloy. Beverage can ends are typically formed from a 5000 series alloy. Aluminum sheets for forming can bodies and can ends are typically coated with a lubricant, such as a wax-like coating of dioctyl sebaccate (DOS) at around 5-10 mg/m$^2$ to prevent scuffing or scratching of the aluminum sheet during coiling, transport, and uncoiling. The amount of DOS is carefully regulated to ensure it is compatible with the subsequent lacquer coatings. Other lubricants may be employed by producers.

For the case of aluminum for forming tabs, the aluminum tab stock typically requires a light oil lubricant for the tab making process in the tab press. The tab stock, which is provided in coils, may be supplied pre-lubricated or a lubricant may be added at the end making plant. After being formed, the tab strip is conveyed to the conversion press where the tab is affixed to the can end shell by a rivet.

Ink jet printing on an aluminum substrate for beverage cans has been disclosed in several prior art references. For example, U.S. Pat. No. 5,992,892, entitled, "Beverage Can Having Instant Winner Type Game Thereon," discloses printing indicia on beverage cans by ink jet printing. Publication WO/2002085553, entitled "Method Of Manufacturing An Aluminum Design Tab End Using An Ink Jet Printing For A Beverage Can" discloses ink jet printing of computerized designs on a tab of a beverage can end.

Yet ink jet printing is not commercially popular on aluminum beverage cans or tabs. Rather, can bodies are decorated usually by dry offset printing in a machine referred to a can decorator. Also, laser ablation of one or more coatings is sometimes commercially employed for tabs.

In addition to decoration for aesthetic, branding, and informational reasons, beverage cans sometimes include dimensional codes, such as QR codes, DataMatrix codes, and the like, which will be referred to herein as 2D codes. 2D codes are well known for providing information to consumers.

Regarding the surface onto which ink can be applied, surface energy (or surface tension) is a fundamental property of solids and varies from low in plastics such as polyethylene (PE) to high for glass and metal surfaces. Surface tension is the analogous property of liquids. For a liquid to wet the surface of a solid, the surface tension of the liquid must be lower than the surface energy or surface tension of the solid. The surface energy is one decisive criterion for the adhesion of printing ink, glue varnish, etc. on many plastic and metal surfaces. Surface energy or surface tension of sheet material is usually measured in mN/m (millinewtons per meter) or in dyn/cm (dynes per centimeter), which have same numerical value. Apart from some exceptions, the general rule is that the higher the surface energy of a material is, the more suitable it is for receiving a coating. It is known that contaminants on a surface can cause low surface energy. As a general limit, 38 dyn/cm is sometimes mentioned as threshold below which adhesion would be poor.

SUMMARY

The present system and method provides a technology for applying ink jet printing technology to a metal substrate, especially an aluminum substrate for use in making beverage cans. Preferably, the ink jet printing process applies indicia or decoration on aluminum tab stock that will be on a beverage can tab.

The inventors have discovered that the DOS coating common to aluminum coil (as supplied from an aluminum mill to beverage can manufacturers) interferes with adherence of the ink on the metal substrate, making the ink jet printing not viable at commercial speeds common in beverage can manufacturing. Further, the inventors surmise that other lubricants may be employed by aluminum coil producers, which may have similar drawbacks for ink jet printing.

The inventors have shown that commercial inks can be applied to conventional aluminum tab stock after the tab stock has been cleaned with a solvent. Other means for increasing the surface energy may be employed.

In one embodiment, a method for forming a beverage can end having ink jet markings on its tab comprises a step of applying ink via an ink jet to a surface of tab stock, wherein the tab stock surface is unlubricated and substantially free of factory lubricant. The method further includes a step of lubricating the tab stock after the step of applying ink, a step of forming the tab stock into tabs, and a step of combining the tabs with an end shell to from the beverage can end.

In another embodiment, a method for forming a beverage can end having ink jet markings on tab stock comprises a step of applying ink via an ink jet to a surface of tab stock, the tab stock surface being unlubricated and substantially free of DOS. After the step of applying ink, the method further comprises a step of rolling the tab stock into a coil, whereby the tab stock is suitable for being formed into beverage or food can tabs.

In yet another embodiment, a tab stock material is unlubricated and substantially free of factory lubricant. The tab stock material includes indicia formed by ink jet printing on a surface of the tab stock material and at least a portion of the surface has a surface energy of less than 44 dyn/cm.

DETAILED DESCRIPTION OF PREFERRED EMBODIMENTS

Figure 1:
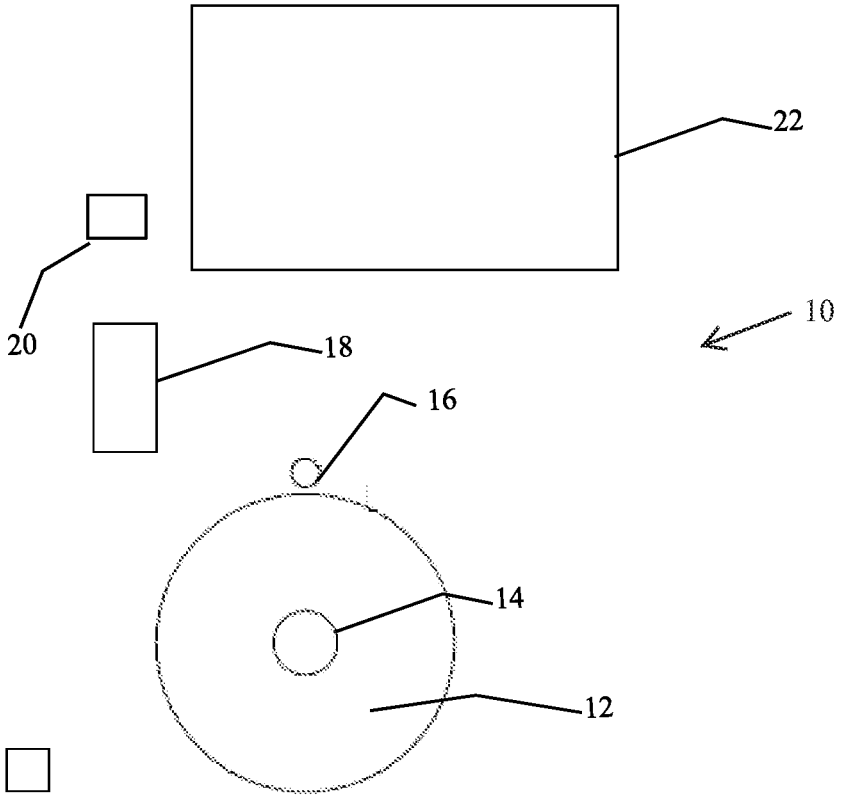
FIG. 1 is a schematic view of a system illustrating aspects of the present invention.

A system and methods for ink jet printing are described for aluminum beverage can tab stock. As shown in FIG. 1, a system 10 for forming a beverage can tabs include a coil 12 of aluminum tab stock, a dereeler 14, an isolation mechanism 16, an ink jet printing station 18, a lubrication station 20, and a tab press 22. Dereeler 14 and isolation roller system 16 preferably are conventional.

Ink jet printing station 18 preferably employs conventional ink jet printing technology using an ink that is compatible with the materials and coating common to the beverage can industry. Lubrication system 20 preferably is conventional. Tab press 22 forms tabs by cutting and bending portions of material strip (not shown in FIG. 1). Press 22, for example, may be a model BSTA-90/20 made by Bruderer of Switzerland or a model PM2-80 made by Minster in the United States.

The coiled tab stock typically has a width for three or four tabs. Tab stock typically is a 5000 series alloy, such as a 5182 alloy having a thickness of 0.0110 inches or less. The tab stock is substantially free of factory lubricant such as DOS such that it has a suitable surface for adherence of coatings from the ink jet printing process. The ink jet printing preferably is applied to the underside of the tab stock (that is, the surface that becomes the underside of the tab upon formation in the tab press). The present invention also encompasses ink jet printing on the top side of the tab stock. High flexibility UV cured inkjet inks are applied during the print process having been fully approved for the intended application.

Figure 2:
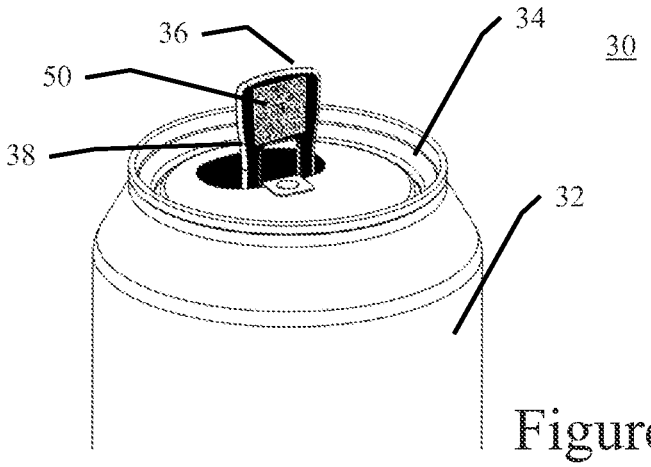
FIG. 2 is a perspective view of beverage can illustrating a first tab embodiment.

FIG. 2 illustrates a beverage can 30 including a can body 32 and a can end 34 attached to can body 32 by a double seam. A tab 36 includes an underside 38 and a top side 40 (not shown in FIG. 2). Indicia 50, illustrated by a 2D bar code such as a QR code, is located on tab underside 38. 2D bar code 50 is produced according to the methods described herein. The present invention encompasses other indicia, such as information, promotional, or sweepstakes information without limitation.

Figure 3:
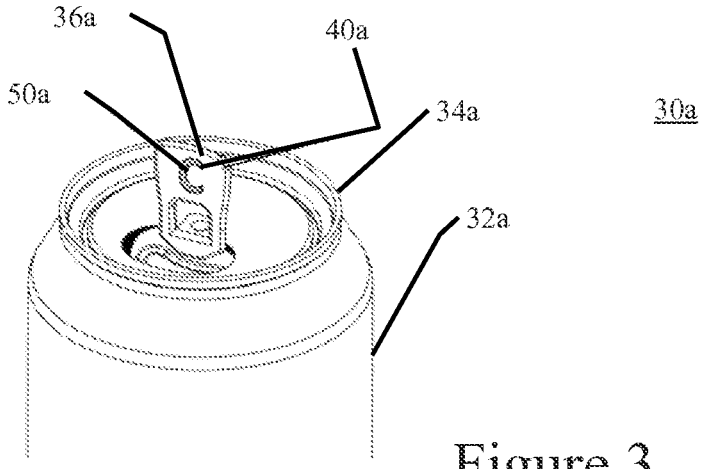
FIG. 3 is a perspective view of beverage can illustrating a second tab embodiment.

FIG. 3 illustrates a beverage can 30*a* that includes a tab 36*a*. Indicia 50*a*, illustrated by a logo, is located on the top side 40*a*. Logo 50*a* is produced according to the methods described herein.

Figure 4:
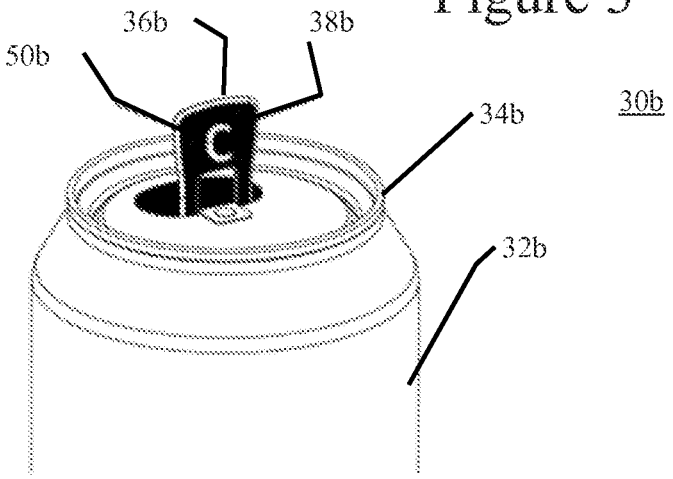
FIG. 4 is a perspective view of beverage can illustrating a first tab embodiment.

FIG. 4 illustrates a beverage can 30*b* that includes a tab 36*b*. Indicia 50*b*, illustrated by a logo, is located on the underside 38*b* of the tab. Logo 50*b* is produced according to the methods described herein in a way such that the inkjet printing forms a negative of logo 50*b*. Logo 50*b* is formed by ink surrounding visible aluminum.

The tab stock coil 12 may come from the supplier substantially free of factory lubricant, such as DOS, or the tab stock may be treated before the ink jet printing station 18. The coil may be cleaned with a conventional solvent chosen for the particular lubricant. Other conventional means, such as corona treatment, plasma treatment, and flame treatment, may be used to increase the surface energy of the tab stock before it enters the ink jet printing station. After forming the printed tabs, the tabs may go to a conversation press (not shown in the figures) for application to can end shells. Alternatively, the ink jet printing may occur before the tab stock is coiled, such as by the aluminum producer.

At least in circumstances in which the factory lubricant is DOS, it may be an advantage to treat, such as by solvent cleaning or other conventional method, the tab stock to have a surface energy that is less than 44 dyn/cm on a surface tension test, preferably less than 42 dyn/cm, or less than 40 dyn/cm, 38 dyn/cm, or more preferably less than 36 dyn/cm on a surface tension test. There is a lower practical limit for the minimum surface energy that will depend on the particular choice of ink and substrate properties, as will be understood by persons familiar with printing on metal packaging substrates.

According to the present technology, the ink jet process is a single stage process, as distinguished from commercial laser ablation of a colored coating. Further, the ink applied by the present technology typically will be dark on a light aluminum background. Therefore, 2D codes would be printed conventionally as opposed to being inverted as might be contemplated with laser etching. In this regard, a 2D code applied by ink jet printing may be easier to read by smartphones and other wireless communication devices. Also, ink jet printing technology is flexible in that is provides many colors, speed that can match commercial tab stock line speeds of over 400 strokes per minute, preferably over 600 strokes per minute, and more preferably over 700 strokes per minute with a two, three, four, or more tab width stock.

Preferred embodiments and methods have been described herein to illustrate aspects of the present invention. The present invention is not limited to the particular embodiments and methods described herein. Rather, the inventors intend the invention to be given its fully scope as defined in the claims.

We claim:

1. A method for forming a beverage can end having ink jet markings on its tab, comprising the steps of:

treating a tab stock with a solvent to remove factory lubricant;

after the step of treating the tab stock, feeding the tab stock into a printing station without coiling the tab stock;

at the printing station applying ink via an ink jet to a surface of the tab stock, the tab stock surface being unlubricated and substantially free of factory lubricant;

after the step of applying ink, feeding the tab stock via a lubrication station directly into a tab press without coiling the tab stock, where the printing station, the lubrication station, and the tab press belong to a system;

forming the tab stock into tabs in the tab press; and combining the tabs with an end shell to form the beverage can end.

2. The method of claim 1 further comprising a step of uncoiling the tab stock, wherein the applying step is performed after the uncoiling step.

3. The method of claim 1 wherein the applying step is performed on an underside of the tab stock.

4. The method of claim 1 wherein the applying step is performed on top side of the tab stock.

5. The method of claim 1 wherein the applying step includes applying indicia to the tab stock.

6. The method of claim 1 wherein the factory lubricant is DOS and the solvent is configured to remove DOS from the tab stock surface.

7. The method of claim 6 wherein, before the applying step, the tab stock has a surface energy of between 36 dyn/cm and 44 dyn/cm on a surface tension test.

8. The method of claim 6 wherein, before the applying step, the tab stock has a surface energy of less than 42 dyn/cm on a surface tension test.

9. The method of claim 6 wherein, before the applying step, the tab stock has a surface energy of less than 40 dyn/cm on a surface tension test.

10. The method of claim 6 wherein, before the applying step, the tab stock has a surface energy of less than 38 dyn/cm on a surface tension test.

11. The method step of claim 1 further comprising steps of receiving the tab stock; and cleaning factory lubricant from the tab stock.

12. The method step of claim 1 further comprising a step of increasing the surface energy of the tab stock.

13. The method of claim 1, wherein the factory lubricant includes DOS, and wherein the tab stock is suitable for being formed into beverage or food can tabs.

14. The method of claim 1, wherein the method for forming the beverage can end is performed at line speeds of over 400 strokes per minute.

15. The method of claim 14, wherein the tab stock includes at least a two tab width stock.

16. The method of claim 2, wherein the treating step is performed after the uncoiling step.

* * * * *